US011225810B2

(12) United States Patent
Bacon

(10) Patent No.: US 11,225,810 B2
(45) Date of Patent: Jan. 18, 2022

(54) OUTDOOR PORTABLE PRIVACY STRUCTURE

(71) Applicant: Lora L. Bacon, Stanton, MI (US)

(72) Inventor: Lora L. Bacon, Stanton, MI (US)

( * ) Notice: Subject to any disclaimer, the term of this patent is extended or adjusted under 35 U.S.C. 154(b) by 189 days.

(21) Appl. No.: 16/681,665

(22) Filed: Nov. 12, 2019

(65) Prior Publication Data

US 2020/0149311 A1 May 14, 2020

Related U.S. Application Data

(60) Provisional application No. 62/760,254, filed on Nov. 13, 2018.

(51) Int. Cl.
*E04H 17/18* (2006.01)
*E04H 17/16* (2006.01)

(52) U.S. Cl.
CPC ..... *E04H 17/18* (2013.01); *E04H 17/165* (2013.01)

(58) Field of Classification Search
CPC ..... E04H 17/22; E04H 17/009; E04H 17/16; E04H 17/1602; E04H 17/165; E04H 17/17; E04H 17/18; E04H 17/185
See application file for complete search history.

(56) References Cited

U.S. PATENT DOCUMENTS 903,686 A * 11/1908 Devany ..... E04H 17/22 52/150
3,875,711 A 4/1975 Palmer
5,577,710 A * 11/1996 Kirby ..... E04H 17/00 256/11
5,730,666 A 3/1998 Hudson
6,896,028 B2 5/2005 Brennan
7,562,865 B2 * 7/2009 Penning ..... E01F 13/022 256/65.14
8,434,963 B2 * 5/2013 Alkas ..... E04B 1/5831 403/306
9,051,751 B2 6/2015 Ogilvie
2004/0188667 A1 * 9/2004 Ray ..... E04H 17/18 256/67
2006/0046899 A1 * 3/2006 Wang ..... A63B 71/023 482/27
2006/0060310 A1 3/2006 Haugen
2006/0060831 A1 * 3/2006 Seas ..... E04H 17/16 256/24
2006/0102218 A1 * 5/2006 Kwon ..... E04H 15/60 135/114
2006/0124912 A1 6/2006 Chavers
(Continued)

FOREIGN PATENT DOCUMENTS

DE 4116738 A1 * 11/1992 ..... E04H 17/146
DE 202014009447 U1 * 2/2015 ..... E04H 17/18
(Continued)

*Primary Examiner* — Jonathan P Masinick
(74) *Attorney, Agent, or Firm* — Michael C. Balaguy

(57) ABSTRACT

A portable privacy structure is disclosed herein. The portable privacy structure includes a a set of structure panels and a set of frame attachment brackets. Each structure panel includes a frame, a privacy screen, a plurality of fasteners and a surface attachment-means. The set of frame attachment brackets connect each structure panel together to provide a privacy wall system that is configured to provide privacy to a user thereof.

13 Claims, 5 Drawing Sheets

(56) References Cited

U.S. PATENT DOCUMENTS

| | | | | |
|---|---|---|---|---|
| 2008/0038048 | A1* | 2/2008 | Pingel | E04H 17/18 403/24 |
| 2011/0031458 | A1* | 2/2011 | Ben Simon | E01F 13/022 256/31 |
| 2011/0146187 | A1 | 6/2011 | Inman | |
| 2015/0115115 | A1* | 4/2015 | Rocke | F16B 5/0692 248/201 |
| 2015/0308058 | A1* | 10/2015 | Boyce | E04H 12/2253 256/32 |
| 2018/0155939 | A1* | 6/2018 | Aldridge | F16B 2/14 |
| 2018/0160801 | A1* | 6/2018 | Felsenthal | A47B 47/00 |
| 2018/0347200 | A1* | 12/2018 | Hooper | E01F 7/025 |
| 2019/0323531 | A1* | 10/2019 | Wang | A01K 15/02 |

FOREIGN PATENT DOCUMENTS

| | | | | |
|---|---|---|---|---|
| DE | 202017004181 | U1 * | 11/2017 | E04H 17/18 |
| GB | 2068036 | A * | 8/1981 | B29C 61/02 |
| WO | WO-2018026862 | A1 * | 2/2018 | E04H 17/22 |

* cited by examiner

OUTDOOR PORTABLE PRIVACY STRUCTURE

CROSS-REFERENCE TO RELATED APPLICATION(S)

The present application is related to and claims priority to U.S. Provisional Patent Application No. 62/760,254 filed Nov. 13, 2018, which is incorporated by reference herein in its entirety.

BACKGROUND OF THE INVENTION

The following includes information that may be useful in understanding the present disclosure. It is not an admission that any of the information provided herein is prior art nor material to the presently described or claimed inventions, nor that any publication or document that is specifically or implicitly referenced is prior art.

TECHNICAL FIELD

The present invention relates generally to the field of privacy structures of existing art and more specifically relates to a portable privacy structure.

RELATED ART

Whether in their own backyard, at a park or campground, or spending time anywhere outside, people may not have the luxury of a fence or wall. Not only do fences and walls offer privacy and discretion, but they also keep unwanted visitors from intruding. Additionally, without a fence or wall, people may feel overly exposed, especially when swimming in a pool. Some people may consider building a fence or wall, but this can be extremely expensive and time consuming. Thus, a suitable solution is desired.

U.S. Publication. No. 2006/0124912 to Roger Chavers relates to a compact privacy fence kit including mating fence components and a kit storage and transport case. The described compact privacy fence kit including mating fence components and a kit storage and transport case includes a case to transport fence components to be assembled and installed to provide a temporary privacy fence assembly, the privacy fence components including, a) a set of rigid fence poles of a generally common length, b) a set of mating spanning fence panels, c) and structure to connect the poles and panels together to assemble them as a privacy fence rapidly and easily.

SUMMARY OF THE INVENTION

In view of the foregoing disadvantages inherent in the known privacy structure art, the present disclosure provides a novel outdoor portable privacy structure. The general purpose of the present disclosure, which will be described subsequently in greater detail, is to provide an improved privacy wall system that is configured to provide privacy to a user thereof.

A portable privacy structure is disclosed herein. The portable privacy structure is for use on a substantially horizontal surface and includes a set of structure panels and a set of frame attachment brackets. Each structure panel may include a frame having four sides. The four sides may include a top side, a bottom side, a left side, and a right side and each of the four sides may have a first section and a second section couplable via a locking mechanism. Further, each structure panel may include a privacy screen; a plurality of fasteners attached about a periphery of the privacy screen (the plurality of fasteners attaching the privacy screen to each of the four sides of the frame); and a surface attachment-means connected to the bottom side of the frame and configured to attach each structure panel to the substantially horizontal surface. The set of frame attachment brackets may be configured to connect each structure panel together. Each frame attachment bracket may include a first half for attachment to one of the sets of structure panels and a second half for attachment to another one of the sets of structure panels.

For purposes of summarizing the invention, certain aspects, advantages, and novel features of the invention have been described herein. It is to be understood that not necessarily all such advantages may be achieved in accordance with any one particular embodiment of the invention. Thus, the invention may be embodied or carried out in a manner that achieves or optimizes one advantage or group of advantages as taught herein without necessarily achieving other advantages as may be taught or suggested herein. The features of the invention which are believed to be novel are particularly pointed out and distinctly claimed in the concluding portion of the specification. These and other features, aspects, and advantages of the present invention will become better understood with reference to the following drawings and detailed description.

BRIEF DESCRIPTION OF THE DRAWINGS

The figures which accompany the written portion of this specification illustrate embodiments and methods of use for the present disclosure, an outdoor portably privacy structure constructed and operative according to the teachings of the present disclosure.

The various embodiments of the present invention will hereinafter be described in conjunction with the appended drawings, wherein like designations denote like elements.

DETAILED DESCRIPTION

Figure 1:
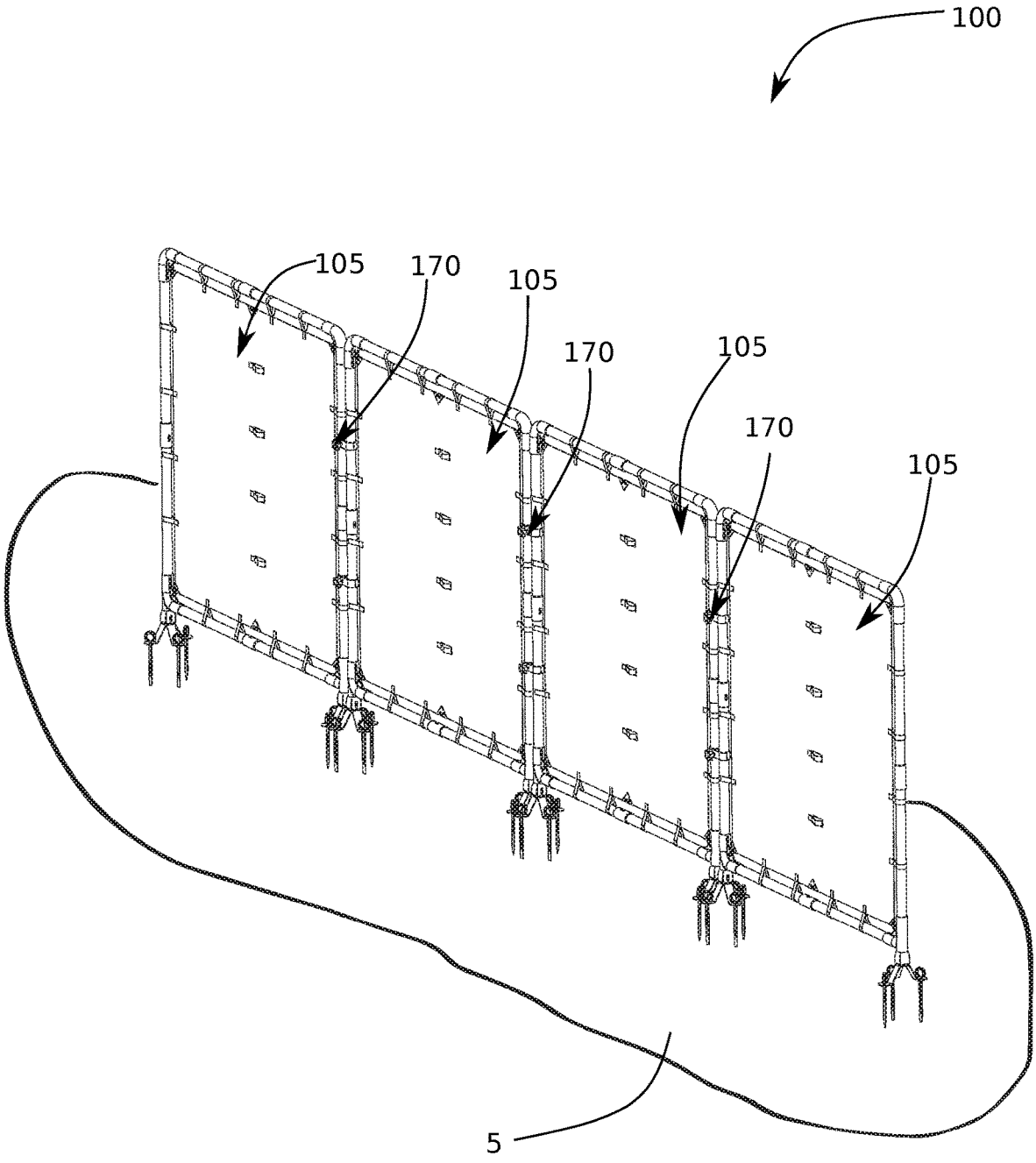
FIG. 1 is a side front view of the portable privacy structure during an 'in-use' condition, according to an embodiment of the disclosure.

As discussed above, embodiments of the present disclosure relate to a privacy structure and more particularly to an outdoor portable privacy structure as used to improve portable structures for providing privacy to a user thereof.

Generally, disclosed is an apparatus having a flexible fabric circumscribed within a frame, wherein the flexible fabric is affixed to a ring on an interior side of the frame via a clip fastener. The flexible fabric may be further affixed to the interior side of the frame via a plurality of loops disposed about a perimeter of the flexible fabric, wherein the loops are secured about the interior side of the frame via a hook and loop fastener or another suitable fastener.

The flexible fabric may be composed of a screen material such that an individual may not see through the flexible fabric. This allows air to pass through and help decrease the possibility of a wall or fence being blown over. The flexible fabric and the frame may be further dimensioned to extend beyond a height of a typical individual, such that the individual may be obscured within the apparatus. In operation, a user may insert secure multiple apparatuses about a perimeter of an enclosure, such that the user may be provided privacy within the enclosure. A pattern on both sides may be included to help obscure the view on either side similar to how a camouflage print functions.

The frame may include left, right, top and bottom sides that break down into two pieces. In this embodiment, the frame comprises a plurality of cylindrical sleeves disposed on each corner thereof, wherein the cylindrical sleeves are securable via a locking mechanism. the cylindrical sleeves each include an aperture wherein a detent is insertable therethrough, wherein the detent is in a biased elevated position. In operation, a user may depress the detent and secure the cylindrical sleeve over the frame, wherein the detent may elevate and secure the sleeve in place. This may allow a user to change the width or height of the frame. Further, two differently sized flexible fabric screens may be provided to accommodate all sizes of the frame.

A pair of ground support members is disposed on opposing sides of a lower end of the frame, wherein each ground support member may include a plurality of ground engaging spikes that are insertable into a ground surface. A bracket may be configured to connect multiple apparatuses to each other, wherein the bracket is disposed on a side of each frame. In operation, a user may insert secure multiple apparatuses about a perimeter of an enclosure, such that the user may be provided privacy within the enclosure.

The bracket comprises a first arcuate member and a second arcuate member each having a central aperture, wherein the first arcuate member and the second arcuate member are secured to each other via a screw fastener that is secured through the central aperture on each arcuate member. In this way, the user may secure multiple apparatuses to each other via the bracket.

Referring now more specifically to the drawings by numerals of reference, there is shown in FIGS. 1-4D, various views of a portable privacy structure 100.

FIG. 1 shows a portable privacy structure 100 during an 'in-use' condition, according to an embodiment of the present disclosure. Here, the portable privacy structure 100 may be beneficial for use on a substantially horizontal surface 5. As illustrated, the portable privacy structure 100 may include a set of structure panels 105 and a set of frame attachment brackets 170. The portable privacy structure 100 may be for use on a substantially horizontal surface 5.

FIGS. 2A-2D show the portable privacy structure of FIG. 1, according to an embodiment of the present disclosure. Each structure panel 105 may include a frame 110 having four sides including a top side 112, a bottom side 114, a left side 116, and a right side 118. Preferably, each of the four sides may have a first section 111 and a second section 113 couplable via a locking mechanism 115. The locking mechanism 115 may be spring actuated. In this embodiment, each of the four sides may be collapsible via uncoupling of the first section 111 and the second section 113 thereof. Further, a height and width of each structure panel 105 may be adjustable via selectively uncoupling and coupling the first section 111 and the second section 113 of each of the four sides.

Figure 2A:
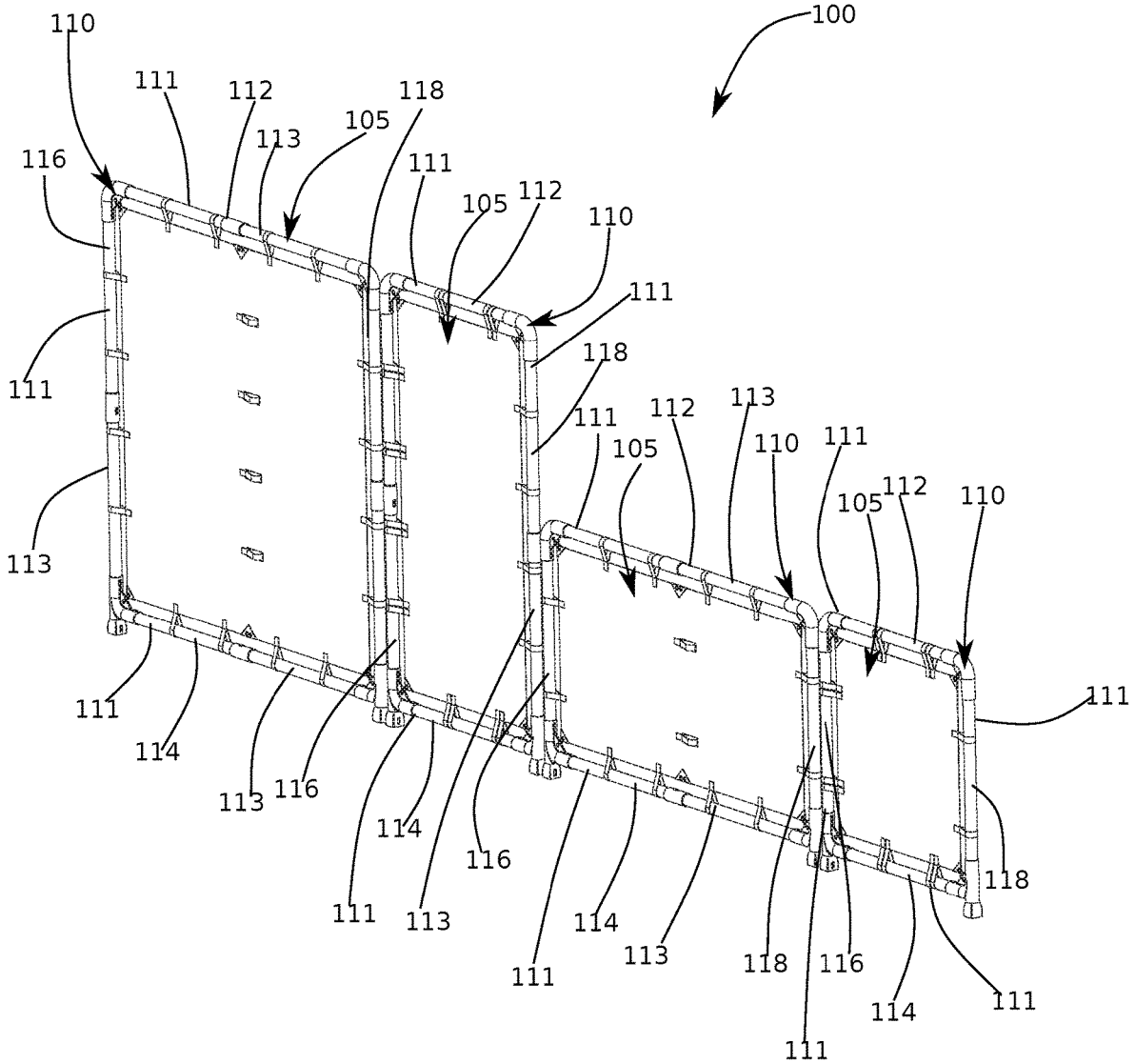
FIG. 2A is a side front view of the portable privacy structure of FIG. 1, according to an embodiment of the present disclosure.
Figure 2B:
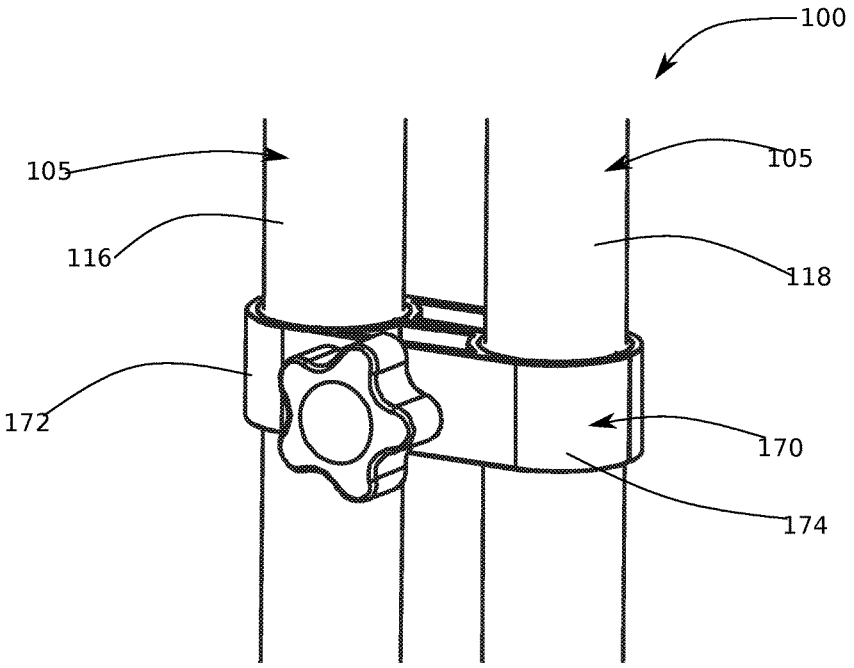
FIG. 2B is a side front view of the portable privacy structure of FIG. 1, according to an embodiment of the present disclosure.
Figure 2C:
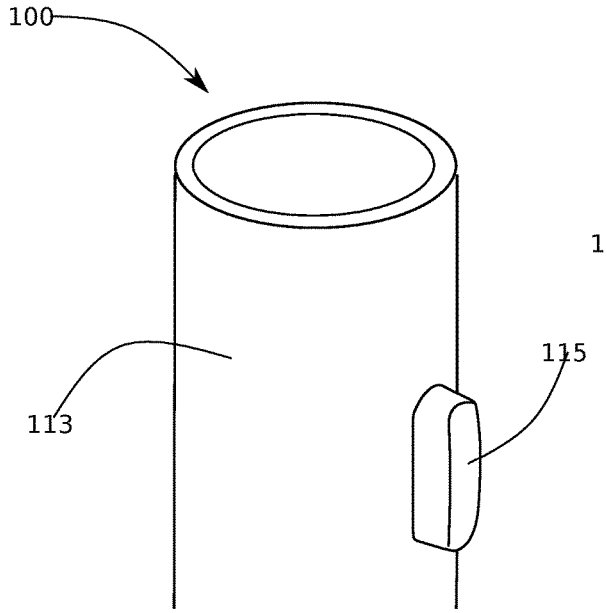
FIG. 2C is a side front view of the portable privacy structure of FIG. 1, according to an embodiment of the present disclosure.
Figure 2D:
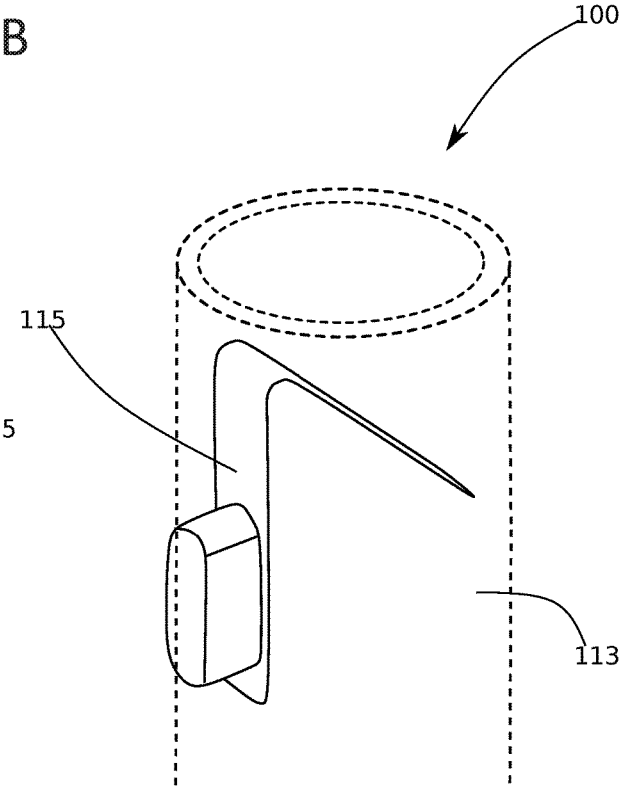
FIG. 2D is a side front view of the portable privacy structure of FIG. 1, according to an embodiment of the present disclosure.

The set of frame attachment brackets 170 may be configured to connect each structure panel 105 together. As illustrated in FIG. 2B, each frame attachment bracket 170 may include a first half 172 for attachment to one of the sets of structure panels 105 and a second half 174 for attachment to another one of the sets of structure panels 105. In some embodiments, the first half 172 and the second half 174 may include an arcuate configuration. In this embodiment, the first half 172 may be configured to circumscribe one of the left side 116 and the right side 118 of said one of the set of structure panels 105 and the second half 174 may be configured to circumscribe one of the left side 116 and the right side 118 of said another one of the set of structure panels 105.

Figure 3:
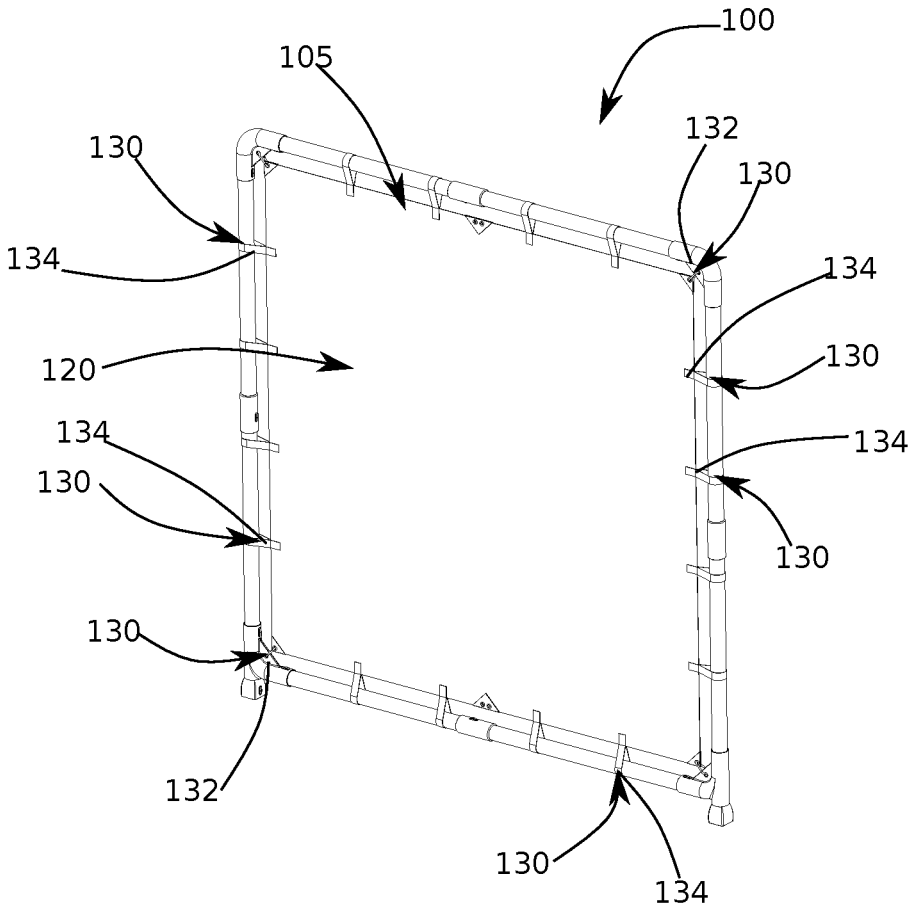
FIG. 3 is a front view of the portable privacy structure of FIG. 1, according to an embodiment of the present disclosure.
Figure 4A:
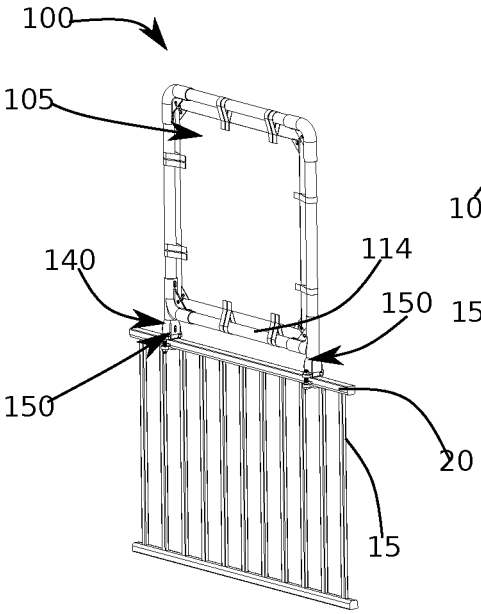
FIG. 4A is a side front view of the portable privacy structure of FIG. 1, according to an embodiment of the present disclosure.
Figure 4B:
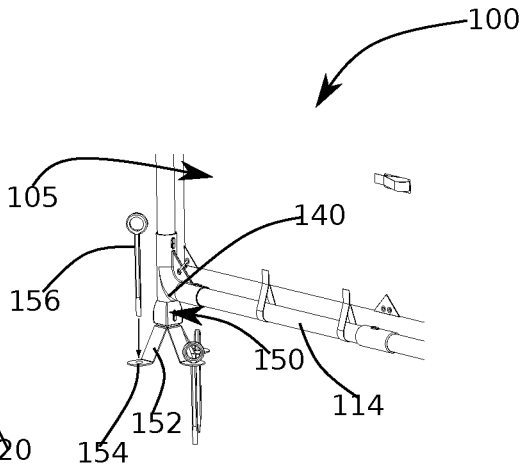
FIG. 4B is a side front view of the portable privacy structure of FIG. 1, according to an embodiment of the present disclosure.
Figure 4C:
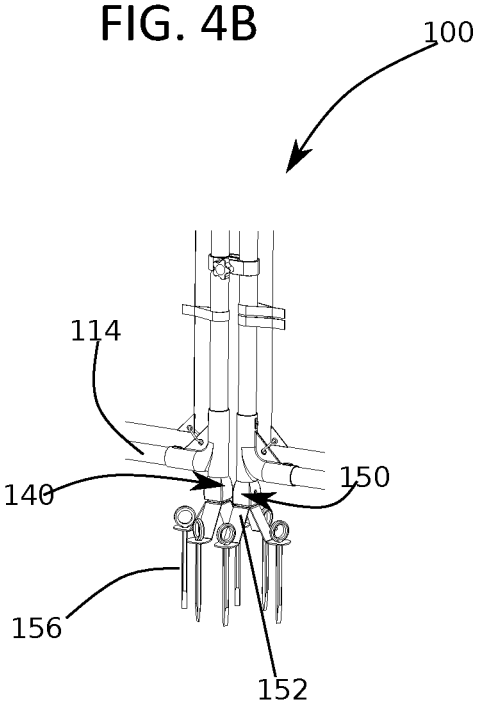
FIG. 4C is a side front view of the portable privacy structure of FIG. 1, according to an embodiment of the present disclosure.
Figure 4D:
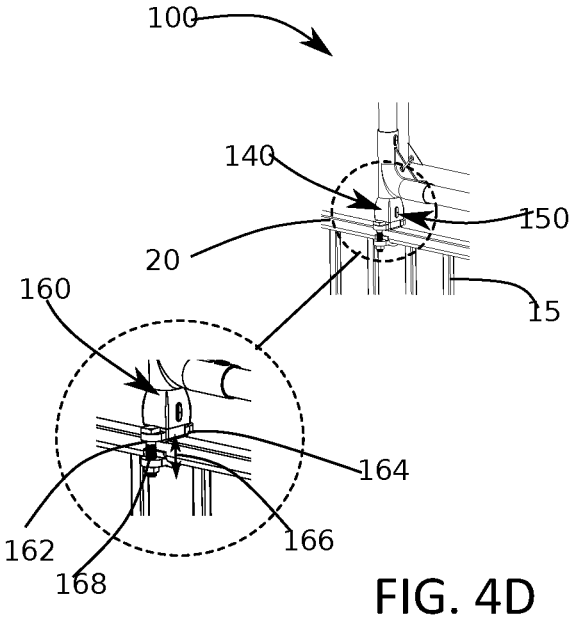
FIG. 4D is a side front view of the portable privacy structure of FIG. 1, according to an embodiment of the present disclosure.

FIG. 3 is a front side view of the portable privacy structure of FIG. 1, according to an embodiment of the present disclosure. As shown, each structure panel 105 may include a privacy screen 120. Preferably, the privacy screen 120 may include a breathable fabric, configured to allow air to pass therethrough. This may prevent a gust of wind from knocking over the structure panel 105. Further, the privacy screen 120 may be made from an opaque fabric to prevent anyone from seeing through the privacy screen 120. In some embodiments, the privacy screen 120 may include patterns such as camouflage, Further, each structure panel 105 may include a plurality of fasteners 130 attached about a periphery of the privacy screen 120, the plurality of fasteners 130 attaching the privacy screen 120 to each of the four sides of the frame 110. As shown, the plurality of fasteners 130 may include a set of clip fasteners 132. Preferably, each clip fastener may attach a corner of the privacy screen 120 to a corner of each structure panel 105. For example, one clip fastener 132 may attach a top left corner of the privacy screen 120 to a top left corner of the structure panel 105. However, it should be appreciated that there may be more than one clip fastener 132 on each corner. Further, the plurality of fasteners 130 may also include a set of loop fasteners 134. As shown, the loop fasteners 134 may attach each side of the privacy screen 120 to each side of the structure panel 105. There may be between 1-4 loop fasteners on each side. However, it should be appreciated that there can be more than 4 loop fasteners on each side.

FIGS. 4A-4D are perspective views of the portable privacy structure of FIG. 1, according to an embodiment of the present disclosure. Each structure panel 105 may include a surface attachment-means 140 connected to the bottom side 114 of the frame 110 and configured to attach each structure panel 105 to the substantially horizontal surface 5 (FIG. 1). In one embodiment, the substantially horizontal surface 5 may be a ground surface 10. In this embodiment, the surface attachment-means 140 may be at least one base-section 150 configured to attach each structure panel 105 to the ground surface 10.

The at least one base-section 150 may include at least one leg 152 having a stake aperture 154 and at least one ground piercing stake 156 may include included and configured for insertion into the stake-aperture 154. Preferably, the at least one base-section 150 may include two base-sections 150 opposite each other; the at least one leg 152 may include three legs 152 each including a stake-aperture 154; and the at least one ground piercing stake 156 may include between 3-6 ground piercing stakes 156. Each of the 3-6 ground piercing stakes 156 may be configured for insertion into the stake-aperture 154. However, it should be appreciated that 6 is not the maximum amount of ground piercing stakes contemplated 156.

In another embodiment, the substantially horizontal surface 5 may be a fence 15. In this embodiment the surface attachment-means 140 may be at least one fence attachment bracket 160 configured to attach each structure panel 105 to a horizontal top surface 20 of the fence 15. Preferably, the at least one fence attachment bracket 160 may include two fence attachment brackets 160 opposite each other. The at least one fence attachment bracket 160 may include a first jaw 162 and a second jaw 164 located parallel to each other. The first jaw 162 and the second jaw 164 may include a space 166 therebetween configured to accept the horizontal top surface 20 of the fence 15. Further, the first jaw 162 and the second jaw 164 may be movable relative to each other via a threaded screw and lever assembly 168 and the movement of the first jaw 162 and the second jaw 164 via the threaded screw and lever assembly 168 may selectively widen and narrow the space 166.

The embodiments of the invention described herein are exemplary and numerous modifications, variations and rearrangements can be readily envisioned to achieve substantially equivalent results, all of which are intended to be embraced within the spirit and scope of the invention. Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application.

What is claimed is new and desired to be protected by Letters Patent is set forth in the appended claims:

1. A portable privacy structure for use on a ground surface, the portable privacy structure comprising:

a set of structure panels, each structure panel including:

a frame having four sides including a top side, a bottom side, a left side, and a right side, each of the four sides having a first section and a second section couplable via a locking mechanism;

a privacy screen;

a plurality of fasteners attached about a periphery of the privacy screen, the plurality of fasteners attaching the privacy screen to each of the four sides of the frame; and a pair of surface attachment-means connected to the bottom side of the frame and configured to attach each structure panel to the ground surface;

a square and non-rotatable interface affixing each of the pair of surface attachment-means to the left side of the frame and the right side of the frame respectively; and a set of frame attachment brackets configured to connect each structure panel together, each frame attachment bracket including:

a first half for attachment to one of the sets of structure panels; and a second half for attachment to another one of the sets of structure panels;

wherein each of the pair of surface attachment-means includes a base-section and a plurality of ground piercing stakes, the base-section having three legs which are separated from one another by an angulation of ninety degrees, such that on one side an angle of one-hundred-and-eighty degrees separates two of the three legs, and such that this angle of one-hundred-and-eighty-degrees faces away from the frame;

wherein the three legs each include a stake-aperture; and wherein each of the plurality of ground piercing stakes are configured for insertion into the stake-aperture.

2. The portable privacy structure of claim 1, wherein the first half and the second half each include a pair of semi-circular reliefs, each of the pair of semi-circular reliefs opening in the same direction as the other one of the pair of semi-circular reliefs, such that when the first-half and the second-half are joined together, a pair of circular bores is formed, each of the pair of circular bores being able to accept and clamp upon one of the four sides of the frame; and wherein the first-half and the second-half each include a screw-bore disposed between the pair of circular bores, arranged such that when the first-half is joined to the second-half, then the screw-bore of the first-half is coaxial with the screw-bore of the second-half; and further comprising a screw which is able to pass between the screw-bore of the first-half and the screw-bore of the second-half and tighten the first-half to the second-half.

3. The portable privacy structure of claim 1, wherein each of the four sides are collapsible via uncoupling of the first section and the second section thereof.

4. The portable privacy structure of claim 3, wherein a height and width of each structure panel is adjustable via selectively uncoupling and coupling the first section and the second section of each of the four sides.

5. The portable privacy structure of claim 1, wherein the privacy screen includes a breathable fabric, configured to allow air to pass therethrough.

6. The portable privacy structure of claim 1, wherein the plurality of fasteners includes a set of clip fasteners.

7. The portable privacy structure of claim 6, wherein the plurality of fasteners further includes a set of loop fasteners.

8. The portable privacy structure of claim 1, wherein the surface attachment-means includes two base-sections located opposite each other and at least six ground piercing stakes, each of the two base-sections having at least three legs, wherein the at least three legs each include a stake-aperture, and wherein each of the at least six ground piercing stakes are configured for insertion into the stake-aperture.

9. The portable privacy structure of claim 1, wherein the locking mechanism comprises a bore perforating the first-section;

an oblong button occupying the bore, the oblong button being able to translate radially relative to the first-section;

a V-shaped leaf spring occupying the first-section interiorly, such that one end of the V-shaped leaf spring presses against the oblong button, and an opposite end of the V-shaped leaf spring presses against the first-section;

wherein the second-section further comprises an aperture, which the oblong button may align with and occupy simultaneously with the bore, such that when the oblong button occupies the aperture, the second-section is retained to the first-section.

10. The portable privacy structure of claim 1, wherein each of the pair of surface attachment-means are attached to the bottom side of the frame by a base-locking mechanism, the base-locking mechanism comprising a bore perforating each of the pair of surface attachment-means;

an oblong button occupying the bore, the oblong button being able to translate radially relative to the first-section;

a V-shaped leaf spring occupying each of the surface attachment-means interiorly, such that one end of the V-shaped leaf spring presses against the oblong button, and an opposite end of the V-shaped leaf spring presses against the first-section;

wherein the second-section further comprises an aperture, which the oblong button may align with and occupy simultaneously with the bore, such that when the oblong button occupies the aperture, the second-section is retained to each of the surface attachment-means.

11. A portable privacy structure for use on a ground surface, the portable privacy structure comprising:

a set of structure panels, each structure panel including:

a frame having four sides including a top side, a bottom side, a left side and a right side, each of the four sides having a first section and a second section couplable via a locking mechanism;

a privacy screen;

a plurality of fasteners attached about a periphery of the privacy screen, the plurality of fasteners attaching the privacy screen to each of the four sides of the frame;

at least one base-section connected to the bottom side of the frame and configured to attach each structure panel to the ground surface, the at least one base-section including at least one leg, the at least one leg having a stake aperture; and a square and non-rotatable interface affixing the at least one base surface to the left side of the frame and the right side of the frame respectively, and;

at least one ground piercing stake configured for insertion into the stake-aperture; and a set of frame attachment brackets configured to connect each structure panel together, each frame attachment bracket including:

a first half for attachment to one of the sets of structure panels; and a second half for attachment to another one of the sets of structure panels.

12. The portable privacy structure of claim 11, wherein the at least one base-section includes two base-sections opposite each other.

13. The portable privacy structure of claim 11, wherein each of the four sides are collapsible via uncoupling of the first section and the second section thereof; and wherein a height and width of each structure panel is adjustable via selectively uncoupling and coupling the first section and the second section of each of the four sides.

* * * * *